United States Patent [19]

Enter

[11] Patent Number: 4,596,185

[45] Date of Patent: Jun. 24, 1986

[54] PRINTING APPARATUS

[75] Inventor: Rudolf Enter, Kitchener, Canada

[73] Assignee: NCR Corporation, Dayton, Ohio

[21] Appl. No.: 663,277

[22] Filed: Oct. 22, 1984

[51] Int. Cl.[4] ..... B41F 13/24

[52] U.S. Cl. ..... 101/235; 101/245

[58] Field of Search ..... 101/52, 53, 74, 75, 101/76, 77, 235, 245, 234, 233, 216, 91, 232, 219, 228; 83/299, 335

[56] References Cited

U.S. PATENT DOCUMENTS

| | | | |
|---|---|---|---|
| 2,173,454 | 9/1939 | Muller | 101/235 |
| 2,741,983 | 4/1956 | Brownell | 101/245 X |
| 3,227,080 | 1/1966 | Hill | 101/228 |
| 3,335,661 | 8/1967 | Moschetti et al. | 101/235 |
| 3,795,190 | 3/1974 | Wallace | 101/233 |
| 4,023,489 | 5/1977 | Beery | 101/235 |
| 4,220,084 | 9/1980 | Maclean et al. | 101/235 |
| 4,278,023 | 7/1981 | Call et al. | 101/235 |
| 4,399,750 | 8/1983 | O'Brien | 101/245 |

*Primary Examiner*—Charles A. Pearson

*Attorney, Agent, or Firm*—Wilbert Hawk, Jr.; Albert L. Sessler, Jr.

[57] ABSTRACT

An endorsement printer for document processing systems is driven in a printing operation cycle by two separate motors. One motor, which may be of the stepping type, drives the endorsement printer in acceleration and deceleration modes before and after the actual operation of imprinting endorsement data on the document being processed. The second motor, which may be of the AC induction type, drives the endorsement printer at substantially constant velocity during the actual imprinting portion of the operation cycle. Cooperating disc and cam elements control the transmission of power from the second motor to the endorsement printer during the constant velocity portion of the cycle, during which the first motor is turned off. A data processing system receives information from a document sensor and a timing disc coupled to the first motor, and controls the operation of said motor.

9 Claims, 10 Drawing Figures

PRINTING APPARATUS

BACKGROUND OF THE INVENTION

Endorsement printers constitute an essential part of many high-speed document processing systems, such as item processors and check sorters, for example. Such printers can imprint various information on the backs and fronts of checks, such as endorsement statements, bank name or other identification, date, etc. Document processing systems of this type are normally designed for a long effective life, such as one hundred million cycles or more, and it is important that the various elements of such systems be capable of long-term reliability with minimum downtime for repair.

Endorsement printers are generally either of the continuously operating type, in which the endorsement printing element is continuously rotating, or of the intermittent operating type, in which the endorsement printing element operates only when a document has been transported to the printing position.

Continuous operation has certain advantages in terms of minimizing acceleration and deceleration of the printing elements, so that some wear and tear on these elements attributable to starting and stopping is avoided. However, there are also disadvantages in this type of system. One of these is a tendency for this type of system to cause undesired ink markings on the documents being processed, since the ink supply roller is in constant motion, and ink is continuously being applied to the printing element. Another disadvantage is that selection of the location of printing by the stamp on the document is difficult or impossible in the case of a continuously rotating system. Furthermore, the fact that the system is continuously operating does tend to increase certain types of wear.

Intermittent operation avoids the above disadvantages, but tends to subject the apparatus to shock loadings, from frequent starts and stops. Also, the intermittent operation tends to be noisier than continuous operation. Existing intermittent operation apparatus may use a clutch to give controlled initiation of the printing sequence for controlled location on the document, but may suffer from electromechanical reliability problems, due to the high accelerations and decelerations involved. Other alternatives include the use of a stepping motor or a D.C. servo motor to rotate and control the endorsement printing element. This requires a large, costly motor, due to the force which must be supplied during the inking and printing cycles, as well as forces required for acceleration and deceleration.

SUMMARY OF THE INVENTION

The present invention relates to printing apparatus, and more particularly relates to printing apparatus which includes dual drive means for a rotary endorsement printer.

In accordance with one embodiment of the invention, a document processing apparatus comprises, in combination, rotary printing means capable of printing indicia on a surface of a document during a printing operation cycle; transport means for moving the document in a predetermined path for delivery of the document to the rotary printing means; back-up roller means for cooperating with the rotary printing means to effect printing on said document; ink supply means for supplying ink to said rotary printing means; sensing means for sensing the presence of a document in said document transport means; first motor means for driving said ink supply means and said rotary printing means during a printing operation cycle initially in an acceleration mode and subsequently in a deceleration mode; second motor means for driving said rotary printing means in a substantially constant velocity mode while printing takes place during said printing operation cycle, and also for driving said back-up roller; timing means coupled to said first motor means for providing information concerning the operation of said first motor means; processor means coupled to said timing means, to said sensing means, and to said first motor means for controlling the operation of said first motor means, to cause said first motor means to operate during said acceleration and deceleration modes and to turn off said first motor means during the time that said rotary printing means is driven by said second motor means; first circular power transmission means driven by said second motor means, and having a peripheral power transmission surface; and second non-circular power transmission means driven by said first motor means, operatively coupled to said rotary printing means, and having a peripheral power transmission surface which engages the peripheral power transmission surface of said first circular power transmission means at times during the printing operation cycle for causing said rotary printing means to be driven by said second motor means at substantially constant velocity during the time that said rotary printing means engages said document for printing.

It is accordingly an object of the present invention to provide an efficient printing apparatus.

A further object is to provide a dual drive endorsement printer.

A further object is to provide an endorsement printer which is driven through part of its printing cycle by one motive means and is driven through the remainder of its printing cycle by a second motive means.

A further object is to provide an endorsement printer in which the location of the endorsement on the document to be endorsed can be controlled.

With these and other objects, which will become apparent from the following description, in view, the invention includes certain novel features of construction and combinations of parts, one form or embodiment of which is herein described with reference to the drawings which accompany and form a part of this specfication.

DETAILED DESCRIPTION

Figure 1:
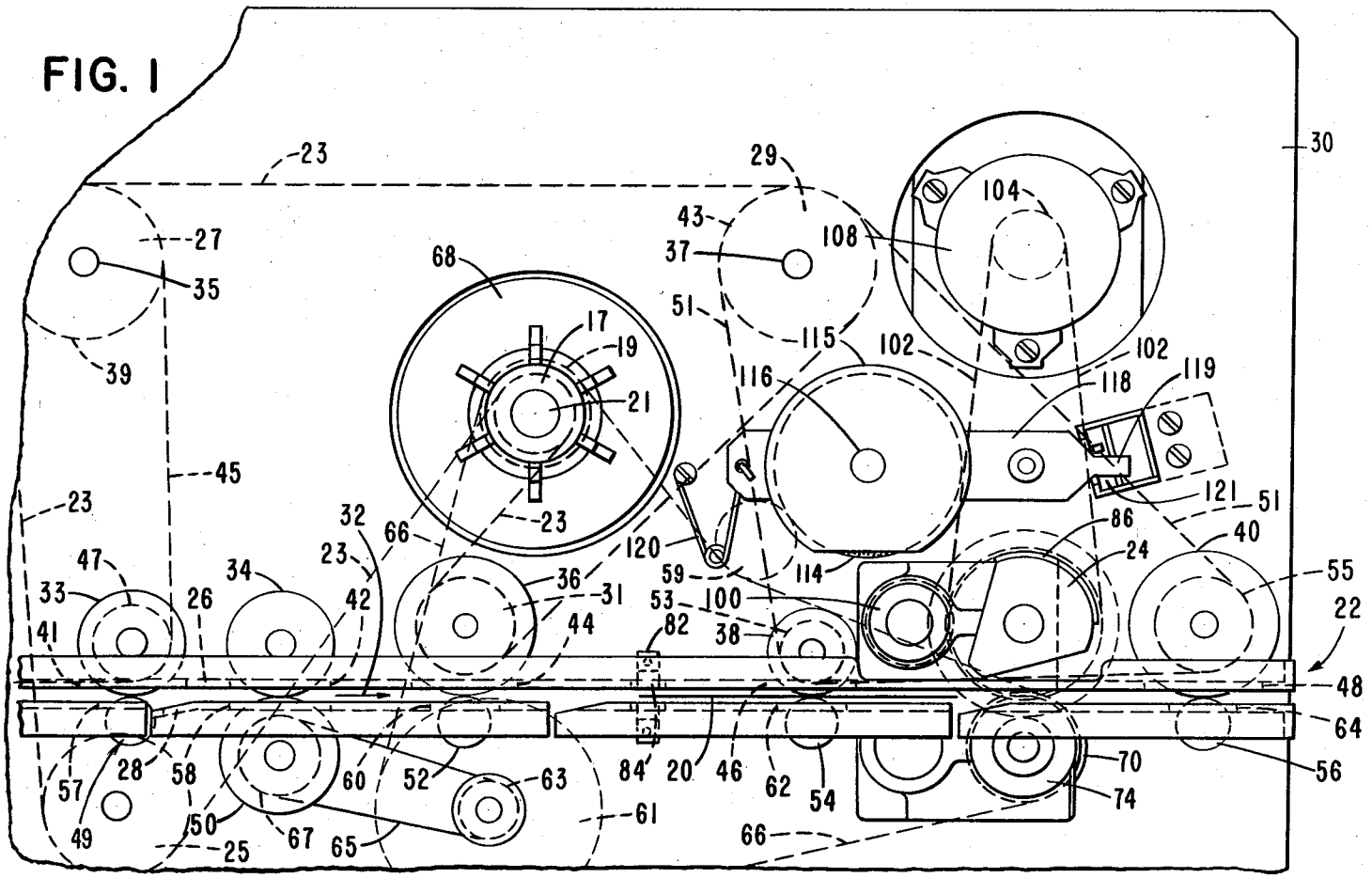
FIG. 1 is a plan view of the endorser of the present invention, also showing associated drive mechanism, inking mechanism and document transport mechanism.
Figure 2:
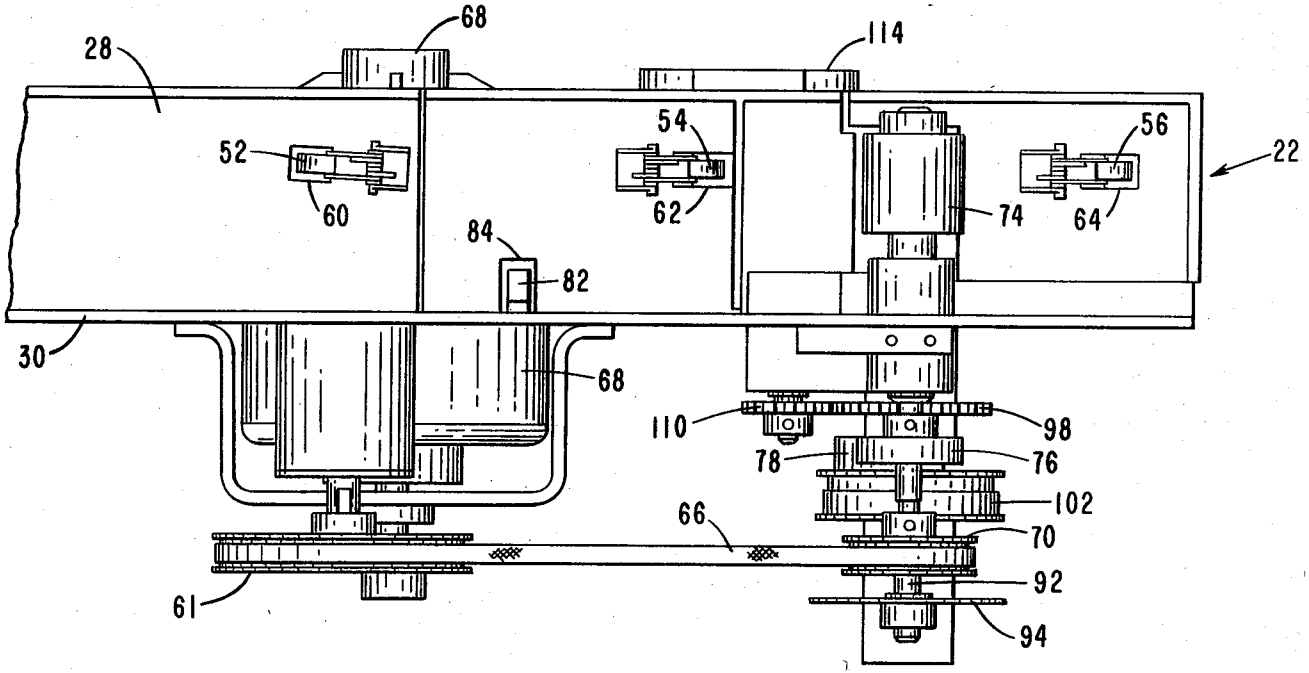
FIG. 2 is an elevation view of the mechanism of FIG. 1.
Figure 3:
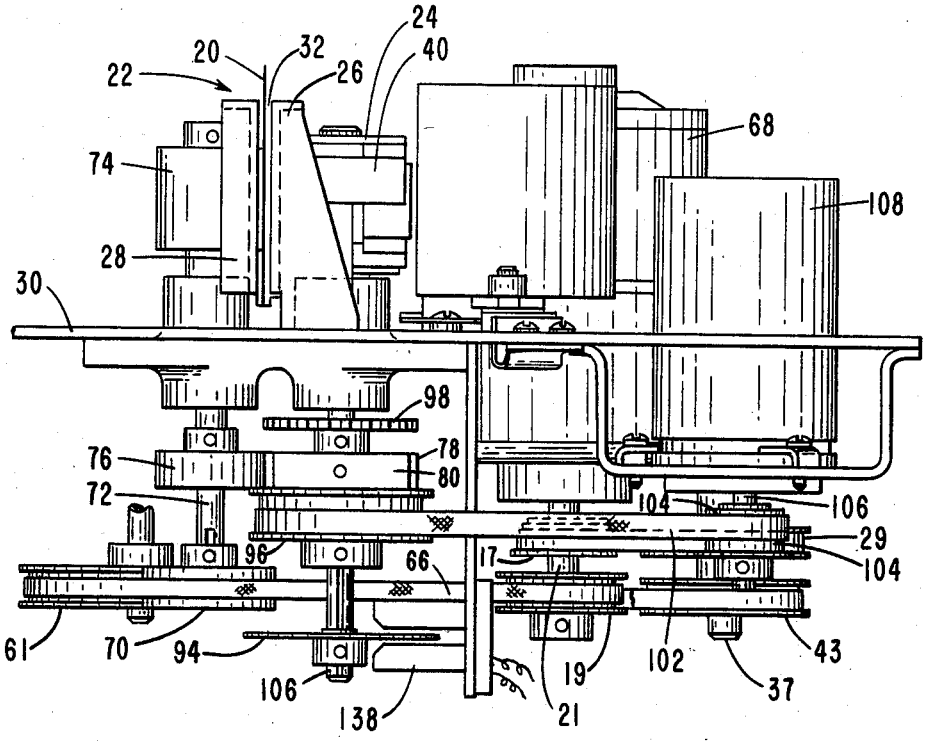
FIG. 3 is an end view of the mechanism of FIG. 1.

Referring now to the drawings, and particularly to FIGS. 1–3 inclusive, a document 20, which may for example be a check, is carried by a document transport 22 to a position in which an endorsement or other indicia may be printed thereon by an endorsement stamp head 24. The document transport 22 comprises first and second walls 26 and 28 secured to a base 30, and defining a document path 32. Rollers such as 33, 34, 36, 38, 40, project through apertures 41, 42, 44, 46, 48, in the wall 26 and cooperate with complementary rollers 49, 50, 52, 54, 56, which extend through apertures 57, 58, 60, 62, 64, to drive the document 20 from left to right, as viewed in FIG. 1. The drive rollers 33, 50, 36, 38, 40, are driven by a motor 68, which is preferably a constant speed, constantly operating motor, such as, for example, an AC induction motor, through various belt and pulley arrangements, as shown in FIGS. 1 to 4 inclusive.

Pulleys 17 and 19 are fixed to a shaft 21 of the motor 68 and are driven by said motor. A belt 23 is driven by pulley 17 and in turn drives pulleys 25, 27, 29 and 31, to which drive roller 36 is coupled. Pulleys 27 and 29 are fixed to shafts 35 and 37, respectively, journaled in the machine framework. Also fixed to the shafts 35 and 37, respectively, are additional pulleys 39 and 43. The pulley 39 acts through a belt 45 and a pulley 47 to drive the feed roller 33 and also drives an additional drive roller (not shown). The pulley 43 acts through a belt 51 and pulleys 53 and 55 to drive the drive rollers 38 and 40 respectively. The pulley 19 on the shaft 21 acts through the belt 66 and idler pulley 59 to drive pulleys 70 and 61. Back-up roller 74 is coupled to pulley 70, and a further pulley 63 is coupled to pulley 61. A belt 65 on the pulley 63 drives a pulley 67 to which is coupled the drive roller 50.

Figure 4:
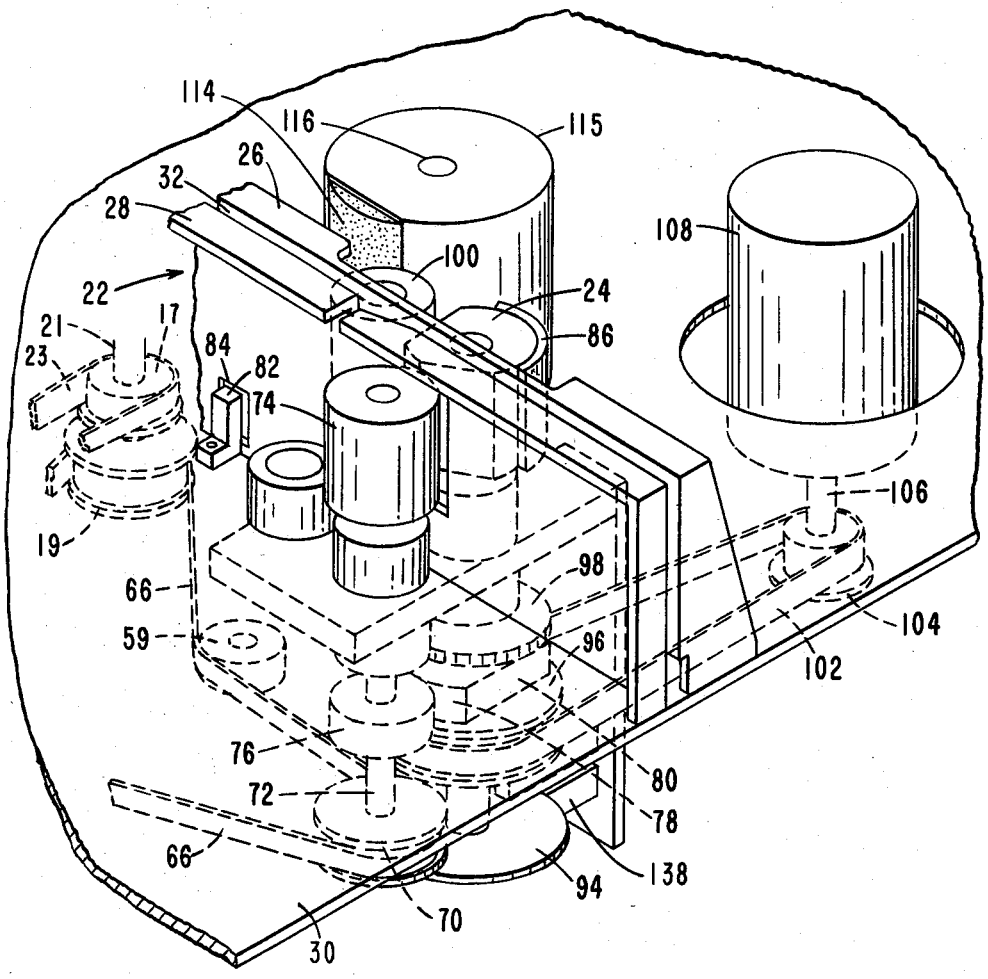
FIG. 4 is a perspective view of the endorsement drive mechanism.

As may best be seen in FIGS. 1 and 4, the motor 68, acting through the belt 66, also drives a pulley 70 secured on a shaft 72. Also secured on the shaft 72 are a back-up roller 74 which cooperates with the stamp head 24 for printing on the document 20, and a friction gear or "tire" 76 which operatively engages at times with a driven cam member 78 of generally circular peripheral configuration, having a flattened sector portion 80.

Figure 10:
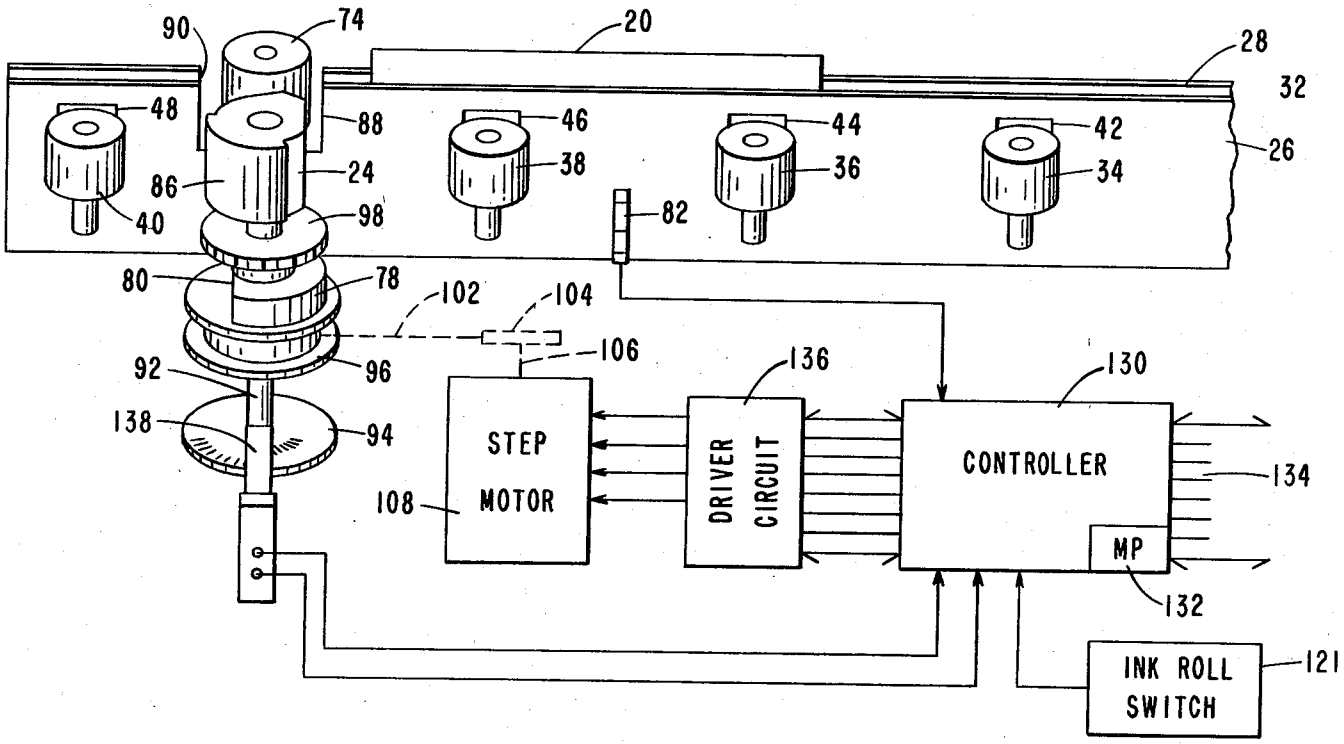
FIG. 10 is a diagrammatic rear view showing the endorser drive mechanism, one of the motors for driving said mechanism, and the electronic circuitry for controlling the operation of said motor.

As the document 20 proceeds along a path 32, its presence is sensed by a sensor 82 (FIGS. 2, 4 and 10) which may be of any suitable design, such as an optical sensor, and which is located adjacent to an aperture 84 (FIG. 1) in the wall 26, so that it can detect the leading edge of a document 20 being transported along the path 32. Rotational printing movement of the stamp head 24 does not commence until after the document 20 has been detected by the sensor 82. An electronic delay following detection of the document 20 by the sensor 82 is provided by a controller 130 (FIG. 10). This delay can be adjusted or programmed to vary the position at which the stamp appears on the document 20 which is being processed.

When the document 20 reaches the location of the stamp head 24, said stamp head, in a rotational printing movement, and acting in cooperation with the back-up roller 74, effects printing on the document 20 of indicia which are carried on the arcuate portion 86 of the stamp head 24. The stamp head 24 and the roller 74 coact through cut-away portions 88 and 90 in the walls 26 and 28 respectively.

As may be seen most clearly in FIG. 10, the stamp head 24 is fixed to a shaft 92 journaled in the supporting structure of the printing mechanism. Also fixed to the shaft 92 are a timing disk 94, a pulley 96, a gear 98 for driving an ink transfer roll 100, and the previously-mentioned driven member 78. The pulley 96 is driven through a belt 102 (FIG. 4) by a driving pulley 104 fixed to the shaft 106 of an intermittently operable motor 108 which may, for example, be a stepping motor.

Figure 5:
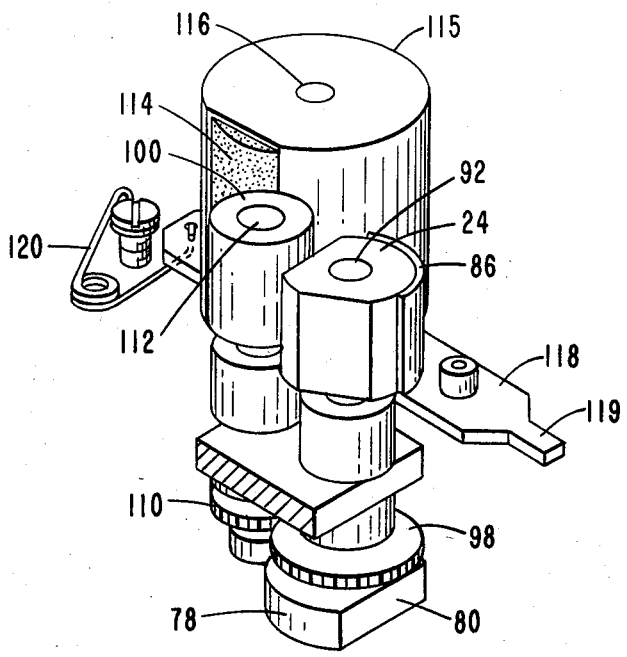
FIG. 5 is a perspective view similar to FIG. 4, showing details of the ink transfer roller drive means.

The gear 98 on the shaft 92 cooperates with a gear 110 (FIG. 5) fixed to a shaft 112 on which is also fixed the transfer roller 100 which serves the function of transferring ink from an ink roll 114 mounted to roll freely on a shaft 116 to the stamp head 24.

The ink roll 114 is housed in a protective plastic shell 115 (FIG. 1). The shaft 116, in turn, is mounted on an arm 118 pivotally mounted on the base 30 and urged in a counterclockwise direction by a toggle spring 120 to cause the ink roll 114 to be pressed against the transfer roller 100, and to thus be rotated by the roller 100, which transmits ink from the roll 114 to the stamp head 24. The toggle spring 120 causes the ink roll 114 to be held in either an engaged position in which it is rotated by the transfer roller 100 and provides ink to the stamp 24, or in a disengaged position in which it is shown in FIG. 1, for maintenance and replacement purposes. A finger 119 at the end of the arm 118 opposite from the spring 120 engages a switch 121 which provides information to a controller 130 (FIG. 10) as to whether or not the ink roll 114 is in place in position to provide ink to the stamp 24. The total printing operation is under control of the controller 130, which includes a microprocessor 132 and other appropriate components, as will readily be apparent to one skilled in the art. The controller 130 communicates with a document processing computer host (not shown) via a bus 134, in order to receive a command as to whether a document 20 is to be printed upon. The controller 130 acts through a driver circuit 136 to operate the motor 108. After the document 20, in its movement along the path 32, has been detected by the sensor 82, a command to operate is transmitted to the step motor 108, which commences rotation of the stamp head 24. The transient position of the stamp head 24 is monitored by the two-channel disk 94 which is fixed to the shaft 92. The disk 94 contains both an inner channel of slots 140 and an outer channel of slots 142, and is sensed by a sensor 138 electrically coupled to the controller 130.

Referring now to FIGS. 6–9 inclusive, these show the relative orientations of the cam member 78, the tire 76, the stamp head 24, the back-up roll 74, the transfer roll 100, the timing disk 94 and the sensor 138 at various stages during a complete revolution of the stamp head 24.

Figure 6:
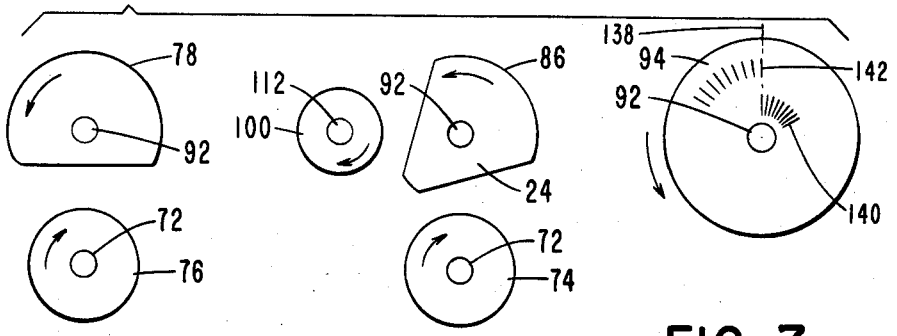
FIGS. 6, 7, 8 and 9 are diagrammatic views of certain elements of the endorser drive mechanism at different points in a cycle of printing operation.
Figure 7:
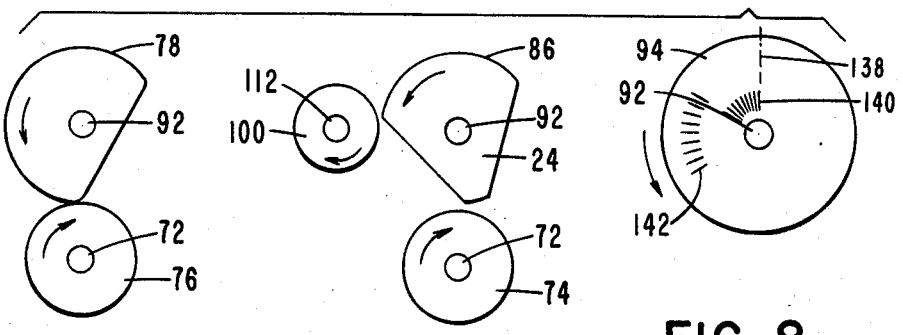
Figure 8:
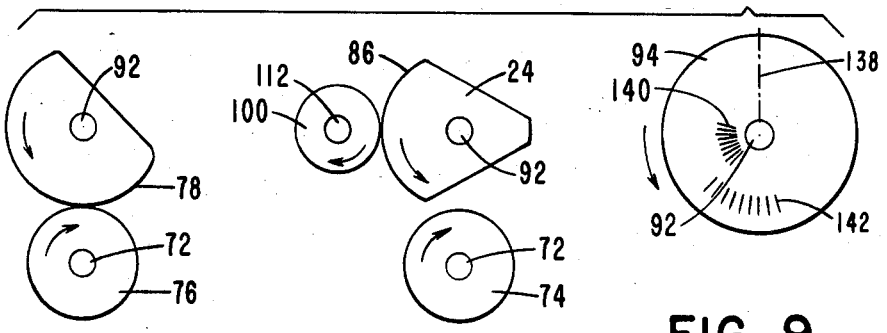

In FIG. 6, the stamp head 24 is shown in its "home" position. This is detected by the microprocessor 132 in the controller 130 by the receiving of signals from the sensor 138 indicating that it has detected both a slot 140 in the inner channel and a slot 142 in the outer channel of the disk 94, which is unique to the "home" position. In this position, it can be seen that the cam member 78 makes no contact with the constantly rotating tire 76, and that the stamp head 24 is not in contact with either the transfer roll 100 or the back-up roll 74.

After a document 20 being transported along the path 32 is sensed by the sensor 82, a signal indicating this is transmitted to the controller 130, and causes a command to be passed to the driving circuit 136 to commence operation of the stepping motor 108. The stepping motor 108 then begins to drive the stamp head 24 at an accelerating rotational velocity in a direction which moves the arcuate printing surface 86 of the head 24 toward engagement with the transfer roll 100. Only slots 140 from the inner disk track or channel of the disk 94 feed pulses to the microprocessor 132, which uses these pulses in standard closed-loop acceleration processes, to cause accelerating movement of the stamp head 24 and associated elements until these elements reach the respective positions shown in FIG. 7, in which the last slot 140 of the inner channel has been sensed, and the sensor senses no slots in either channel. The stepping motor 108, under command of the controller 130, ceases operation and thus ceases applying torque at this point.

Also at this point, the cam element 78 has been rotated sufficiently that the circular portion of its periphery has been brought into engagement with the circumference of the "tire" 76, and the speed of the shaft 92 and the various elements associated therewith, including the cam member 78, have been brought to a rotational speed essentially the same as that at which the shaft 72 and associated elements are driven by the motor 68. Both the "tire" 76 and the cam member 78 have peripheral surfaces having a relatively high coefficient of friction. Frictional driving engagement between the cam member 78 and the "tire" 76, which is driven by the motor 68, now causes rotation of the stamp head 24 in a printing operation which rotates the indicia-bearing ink surface 86 to the position shown in FIG. 8, in which said surface 86 engages the document 20, said document passing between the head 24 and the back-up roll 74. The rotational speed of the head 24 is such as to provide a linear speed of the surface 86 which is substantially the same as the track speed of the document 20.

Figure 9:
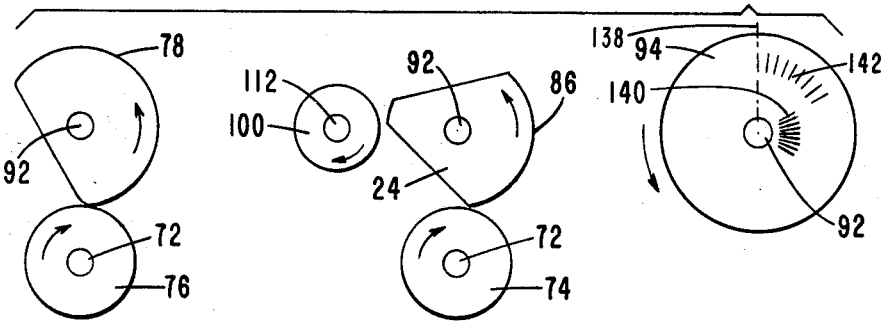

The motor 68 continues to drive the head 24 through the printing operation and until the various elements reach the respective positions shown in FIG. 9. At this point, the cam member 78 has rotated sufficiently that the flattened portion of its periphery is about to be positioned opposite the circumference of the tire 76, thus interrupting the engagement of these two elements, and terminating the driving of the head 24 by the motor 68. At the same time, the disk 94 has been rotated sufficiently that the end slot 142 of the outer channel is sensed by the sensor 138, which causes the controller 130, acting through the driver circuit 136, to initiate operation of the step motor 108. Pulses generated by sensing of the slots 142 are used in standard closed-loop deceleration processes to cause deceleration of the head 24 and to stop it at the "home" position shown in FIG. 6.

It may be noted that in the illustrated embodiment, the ratio of the pulleys 96 and 104 requires the motor 108 to rotate twice for one revolution of the stamp head 24. This is done in order to reduce the load inertia seen by the motor 108.

One benefit of the design of the present invention is that it uses the greater, relatively low cost, power of the constant-speed motor 68, present in the printing apparatus and used for other purposes as well, to provide motive power for the stamp head 24 while it is in rolling engagement with the transfer roll 100 and the document 20. Since the motor 68 is also used to drive the rollers comprising the document transport means, the movement of the document 20 is synchronized with the movement of the stamp head 24 during the imprinting operation. Movement during this interval requires substantial power, and would also present shock loads to the motor 108, if it were used during this part of the cycle. In this system, the motor 108 may be of relatively smaller size, since it is needed only to provide accelerating and decelerating torque. System power supply costs and driver circuitry, as well as a smaller motor, thus provide opportunities for economy.

While the invention has been shown and described in terms of a preferred embodiment thereof, it will be understood that this invention is not limited to this particular embodiment and that many changes and modifications may be made without departing from the true spirit and scope of the invention as defined in the appended claims.

What is claimed is:

1. A document processing apparatus comprising, in combination:

rotary printing means capable of printing indicia on a surface of a document during a printing operation cycle;

transport means for moving the document in a predetermined path for delivery of the document to the rotary printing means;

back-up roller means for cooperating with the rotary printing means to effect printing on said document;

ink supply means for supplying ink to said rotary printing means;

sensing means for sensing the presence of a document in said document transport means;

first motor means for driving said ink supply means and said rotary printing means during a printing operation cycle initially in an acceleration mode and subsequently in a deceleration mode;

second motor means for driving said rotary printing means in a substantially constant velocity mode while printing takes place during said printing operation cycle, and also for driving said back-up roller;

timing means coupled to said first motor means for providing information concerning the operation of said first motor means;

processor means coupled to said timing means, to said sensing means, and to said first motor means for controlling the operation of said first motor means, to cause said first motor means to operate during said acceleration and deceleration modes and to turn off said first motor means during the time that said rotary printing means is driven by said second motor means;

first circular power transmission means driven by said second motor means, and having a peripheral power transmission surface; and second non-circular power transmission means driven by said first motor means, operatively coupled to said rotary printing means, and having a peripheral power transmission surface which engages the peripheral power transmission surface of said first circular power transmission means at times during the printing operation cycle for causing said rotary printing means to be driven by said second motor means at substantially constant velocity during the time that said rotary printing means engages said document for printing.

2. The document processing apparatus of claim 1 in which the first motor means is a stepping motor.

3. The document processing apparatus of claim 1 in which the second motor means is an AC induction motor.

4. The document processing apparatus of claim 1 in which the timing means comprises an apertured disk and cooperating optical sensor means.

5. The document processing apparatus of claim 4 in which apertures are located on the disk in inner and outer concentric tracks, with the apertures in the outer track controlling the processor means during the acceleration mode and the apertures in the inner track controlling the processing means during the deceleration mode.

6. The document processing apparatus of claim 1 in which the first circular power transmission means is a disk having a peripheral surface of a relatively high coefficient of friction.

7. The document processing apparatus of claim 6 in which the second non-circular power transmission means comprises a cam configuration having a peripheral surface of a relatively high coefficient of friction which engages the peripheral surface of said first circular power transmission means only during the substantially constant velocity portion of the printing revolution cycle.

8. The document processing apparatus of claim 1 in which the ink supply means comprises an ink transfer roller driven by said first motor means and an ink supply roller yieldably urged into engagement with said ink transfer roller.

9. The document processing apparatus of claim 1 in which the second motor means also drives the transport means.

* * * * *